US009603387B2

(12) United States Patent
Liu

(10) Patent No.: US 9,603,387 B2
(45) Date of Patent: Mar. 28, 2017

(54) ELECTRONIC CIGARETTE AND ITS SOFT SUCKING ROD

(71) Applicant: KIMREE HI-TECH INC., Tortola (VG)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 942 days.

(21) Appl. No.: 13/884,953

(22) PCT Filed: Dec. 28, 2012

(86) PCT No.: PCT/CN2012/087878

§ 371 (c)(1),
(2) Date: May 10, 2013

(87) PCT Pub. No.: WO2014/101129

PCT Pub. Date: Jul. 3, 2014

(65) Prior Publication Data

US 2015/0296884 A1 Oct. 22, 2015

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |
| ***H05B 3/03*** | (2006.01) |
| ***H05B 3/44*** | (2006.01) |

(52) U.S. Cl.

CPC ..... *A24F 47/008* (2013.01); *H05B 3/03* (2013.01); *H05B 3/44* (2013.01); *H05B 2203/014* (2013.01); *H05B 2203/021* (2013.01); *H05B 2203/022* (2013.01)

(58) Field of Classification Search

None

See application file for complete search history.

(56) References Cited

U.S. PATENT DOCUMENTS

2012/0279512 A1* 11/2012 Hon ..... A24F 47/008 131/329
2013/0255675 A1* 10/2013 Liu ..... A61M 11/041 128/202.21

FOREIGN PATENT DOCUMENTS

CN 202005248 U * 10/2011 ..... A24F 47/008
CN 202618275 U * 12/2012 ..... A24F 47/008

* cited by examiner

*Primary Examiner* — Michael H Wilson
*Assistant Examiner* — Phu Nguyen
(74) *Attorney, Agent, or Firm* — Cheng-Ju Chiang

(57) ABSTRACT

The present invention relates to a soft sucking rod for electronic cigarette, the soft sucking rod includes a sucking rod sleeve and a liquid smoke cup configured within the sucking rod sleeve and an atomizer; the sucking rod sleeve is made of soft materials, the liquid smoke cup is configured with a liquid storage component therein for accommodating liquid smoke, the liquid storage component defines a through hole coaxially extended therethrough as a smog channel, the atomizer is configured in the smog channel of the liquid smoke cup, the atomizer atomizes the liquid smoke which is near the atomizer and stored in the liquid storage component. The soft sucking rod has good touch feel and mouth feel when hold in hand, and has simple and compact internal structure and low manufacturing cost.

8 Claims, 7 Drawing Sheets

ELECTRONIC CIGARETTE AND ITS SOFT SUCKING ROD

CROSS REFERENCE TO RELATED APPLICATIONS

The present application is a 35 U.S.C. §371 National Phase conversion of International (PCT) Patent Application No. PCT/CN2012/087878, filed on Dec. 28, 2012, the disclosure of which is incorporated by reference herein. The PCT International Patent Application was filed in Chinese.

TECHNICAL FIELD

This invention relates to a field of electronic cigarette, and particularly to an electronic cigarette sucking rod having a soft shell.

DESCRIPTION OF BACKGROUND

Current electronic cigarette sucking rods each comprise: a sucking cylinder, a liquid smoke cup configured within the sucking rod sleeve for reserving liquid smoke and an atomizer configured within the sucking rod sleeve for transforming the liquid smoke into smog, and a liquid guiding component configured between the liquid smoke cup and the atomizer dedicated to guide the liquid smoke into the atomizing device, and an outtake is configured at a central portion of the liquid smoke cup in a manner of being axially extended to work as a smog channel for circulation.

The current electronic cigarette sucking rods have the following shortcomings: since the sucking rod sleeve is made of rigid materials, it is not good in touch feel and mouth feel; since the liquid smoke cup is configured with a dedicated liquid guiding component and outtake, it has a complicated internal structure, more components, and high manufacturing cost.

SUMMARY

An object of the present invention is to provide a soft sucking rod for electronic cigarette, having good touch feel and mouth feel, and simple and compact internal structure and low manufacturing cost.

To achieve the above object, the present invention discloses a soft sucking rod for electronic cigarette, which comprises a sucking rod sleeve with hollow inner chamber, a liquid smoke cup configured within the sucking rod sleeve for reserving liquid smoke and an atomizer for transforming the liquid smoke into smog; wherein, the sucking rod sleeve is made of soft materials, the liquid smoke cup is configured with a liquid storage component therein for reserving the liquid smoke, the liquid storage component defines a through hole in its central portion as a smog channel, the atomizer is configured in the smog channel of the liquid smoke cup, the atomizer atomizes the liquid smoke which is near the atomizer and stored in the liquid storage component.

Wherein, the sucking rod sleeve has its opposite ends to be respectively configured with a nozzle and a power rod connector for connecting with an external power supply, the liquid smoke cup comprises the nozzle and a cup holder which are opposite to and separate from each other in a certain distance and tightly engaged with an inner wall of the sucking rod sleeve by expansion, and a liquid storage component fixed between the nozzle and the cup holder, and a liquid storage space of the liquid smoke cup is defined jointly by the nozzle, the cup holder and the sucking rod sleeve.

Wherein, the liquid storage component is cylindrical and configured with the through hole coaxially extended therethrough.

Wherein, the nozzle comprises a cylindrical cover body and a first positioning post coaxially extended from an end of the cover body, the nozzle defines a nozzle vent coaxially extended through the cover body and the first positioning post, the nozzle is made of soft materials.

Wherein, the cup holder has a cylinder cup-shaped structure, and enclosed by a side wall and a bottom wall to form an inner chamber, the cup holder is configured with a second positioning post axially extended from its bottom wall, an annular inner chamber is defined between the second positioning post and an inner wall of the cup holder for accommodating the liquid storage component, the cup holder defines a cup holder vent coaxially extended through the second positioning post and the bottom wall, the first positioning post of the nozzle and the second positioning post of the cup holder is corresponded to each other, and both of them are inserted into the through hole of the liquid storage component and respectively fix opposite ends of the liquid storage component and support the liquid storage component.

Wherein, the liquid storage component further defines a stepped groove at its end engaged with the cup holder for insertion of the cup holder.

Wherein, the atomizer comprises a heating wire and a fiber member for supporting the heating wire and absorbing the liquid smoke, the fiber member is fixed within the through hole in a radial direction of the liquid storage component and its opposite ends abut against the liquid storage component to absorb the liquid smoke for the heating wire to atomize it; the heating wire is wound around the fiber member, opposite ends of the heating wire are respectively attached on a side wall of the through hole and pass out of the cup holder and are electrically connected with the positive electrode and the negative electrode of the power rod connector; the cup holder of the liquid smoke cup further defines perforations axially extended through the bottom wall of the cup holder for extension of the heating wire, and junctions between the heating wire and the perforations are circumferentially sealed.

Wherein, the cup holder is cylinder-shaped, and defines a venthole coaxially extended therethrough, and two perforations axially extended therethrough at opposite sides of the venthole, and the cup holder is further configured with an annular hermetical ring on its side wall for sealing and tightly engaging by expansion with the sucking rod sleeve.

Wherein, the atomizer is a heating wire, and comprises a spiral main part and a first electronic wire and a second electronic wire disposed at opposite ends of the main part and respectively serving as positive and negative electrodes, the main part is affixed onto an inner wall of the through hole of the liquid storage component and is coaxial with the liquid storage component, and the first electronic wire and the second electronic wire pass through the through hole and further go out of the cup holder to be electrically connected with the positive and negative electrodes of the power rod connector.

Wherein, the first electronic wire extends along the inner wall of the through hole beyond a first end surface of the liquid storage component adjacent to the nozzle and extends along the first end surface after a first bending, and then extends along the outer wall of the liquid storage component to a second end surface of the liquid storage component adjacent to the cup holder after a second bending, then continues to extend along the second end surface of the liquid storage component to a corresponding perforation of the cup holder after a third bending, and passes through the perforation after a fourth bending to be electrically connected with the first electrode of the power rod connector; the second electronic wire extends along the inner wall of the through holes beyond the second end surface of the liquid storage component adjacent the cup holder and extends to a corresponding perforation along the second end surface after a first bending, and passes through the perforation after a second bending to be electrically connected with the second electrode of the power rod connector.

Wherein, the power rod connector comprises a connecting member serving as a first electrode of the atomizer, a sucking rod electrode serving as a second electrode of the atomizer and an insulating member for insulating the connecting member and the sucking rod electrode; the sucking rod electrode is inserted into a central portion of the connecting member by means of the insulating member.

Wherein, the connecting member is substantially hollow cylinder-shaped, and comprises a cylindrical main portion having an increased diameter and a cylindrical connecting portion having a reduced diameter, and a positioning flange is configured between the main portion and the connecting portion and radially outwardly extended from the main portion for engaging with a connecting end of the sucking rod sleeve, the main portion is inserted into and positioned in the sucking rod sleeve, the connecting portion is configured with an outer thread joint for connecting with a power rod and an intake hole for air to come in; the connecting member further defines a locking slot in its inner wall for mounting the sucking rod electrode, and the sucking rod electrode is inserted into the locking slot of the connecting member by means of the insulating member; the sucking rod electrode further defines a vent coaxially extended therethrough.

Wherein, the liquid storage component is non-woven cloth, wood pulp cotton, chemical fiber cotton or PVA which have liquid-absorbent and liquid barrier properties.

The present invention further discloses an electronic cigarette device, which comprises a sucking rod and a power rod, wherein, the sucking rod is a soft sucking rod as described above.

Wherein, the power rod comprises a cylindrical power rod sleeve and a sucking rod connecter for connecting with the sucking rod and a bottom cap respectively configured at opposite ends of the power rod sleeve, the power rod sleeve is made of soft materials, the power rod sleeve is configured with a storage power, a control assembly and a control assembly holder therein, the storage power has its positive and negative electrodes to be electrically connected with positive and negative electrodes of the sucking rod connector respectively, the bottom cap defines an intake.

The electronic cigarette and its soft sucking rod of the present invention have the following advantages: the sucking rod sleeve and the label layer wrapping the sucking rod sleeve both are made of soft materials, to have good touch feel, and the nozzle of the sucking rod sleeve is soft and can be bit, and has good mouth feel, and similar feeling to smoke a real cigarette, and makes the sucking rod with good simulation results. The heating wire of the atomizer is directly configured in the through hole of the liquid storage component, and atomizes the liquid smoke in the through-hole, the smog atomized in the liquid smoke cup passes through the through hole and the nozzle vent defined in the nozzle of the liquid smoke cup to an exterior of the sucking rod, there is no need to set up an additional liquid guiding component, and no need to specially set up a vent tube as a smog channel in the liquid smoke cup, it is only the liquid storage component to reserve the liquid smoke, simultaneously, the nozzle is also a part of the liquid smoke cup, to make the entire sucking rod simple and compact in inner structure, and save manufacture cost. Furthermore, the nozzle is made of soft materials, to get better mouth feel of the electronic cigarette.

The embodiments of the present invention are further described in detail as follows in conjunction with the accompanying drawings.

DETAILED DESCRIPTION OF THE EMBODIMENTS

It should be noted that, the embodiments and the characteristics in the embodiments can be mutually combined in case of no confliction. The present invention would be further described in detail as follows in conjunction with the accompanying drawings and the embodiments.

Figure 1:
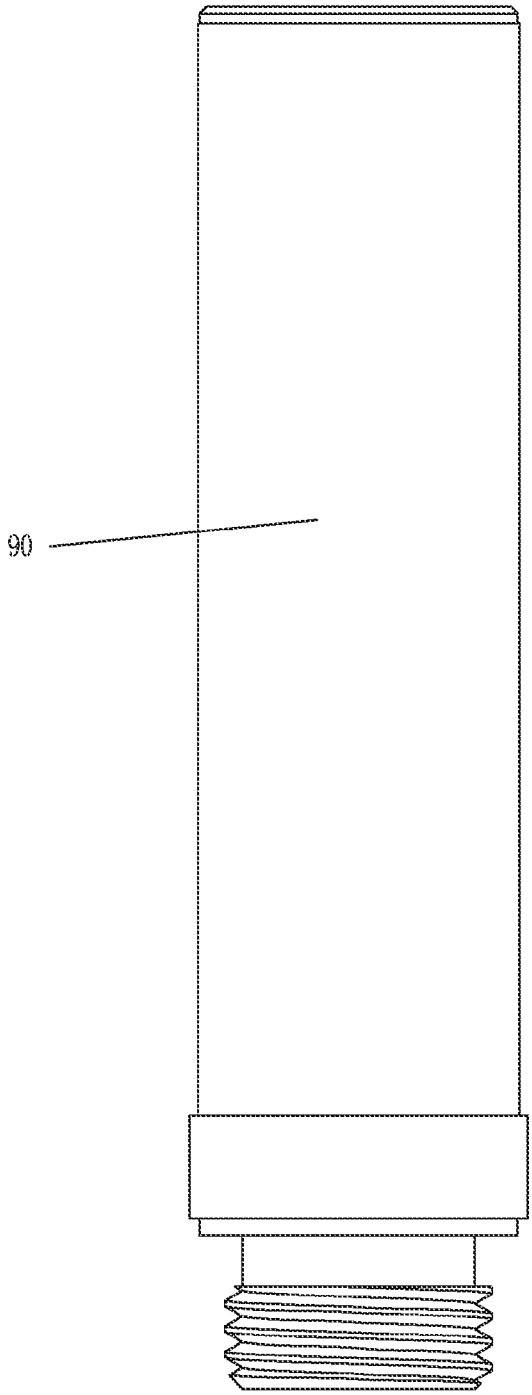
FIG. 1 is a main view of a soft sucking rod for electronic cigarette in accordance with a first embodiment of the present invention.

As shown from FIG. 1 to FIG. 6, an embodiment of the present invention provides a soft sucking rod 90 for electronic cigarette, the sucking rod 90 comprises a sucking rod sleeve 1, an atomizer 2 and a liquid smoke cup 3 both configured within the sucking rod sleeve 1, the sucking rod sleeve 1 has its opposite ends to be respectively configured with a nozzle 4 and a power rod connector 5 for connecting with an external power supply. For clear description, the orientation as shown in FIG. 1 is referenced hereafter in the present embodiment.

The sucking rod sleeve 1 is made of soft materials having the required strength and flexibility, for example, plastic material, paper-based material, rubber material, silicone material, or fiber material, wherein the plastic material exemplarily is any one of the following materials: PC, PP, PVC, ABS, PET or PE, the paper-based material is the paper with the desired hardness, such as: food wrapping paper, writing paper, fiber paper, coated paper or kraft paper; the fiber material is a chemical fiber tube, wood fiber tube or fiberglass tube. Since the sucking rod sleeve 1 is made of soft materials, it has good touch feel when hold in hand, secondly, using the soft materials can save production cost, and an outer wall of the sucking rod sleeve 1 made of soft materials is easy to be affixed with a label layer of trademarks or advertising. The power rod connector 5 has its one end inserted into the sucking rod sleeve 1 and tightly engaged with an inner wall of the sucking rod sleeve 1 by expansion, and a positioning member is sleeved around the outer wall of an end of the sucking rod sleeve 1 engaged with the power rod connector 5 for firmly clamping the sucking rod sleeve 1 and the power rod connector 5, in this embodiment the positioning member is an annular positioning ring 16. The outer wall of the sucking rod 1 is further configured with a label layer 17 for advertising or trademarks, the label layer 17 is capable of soft materials of labels or stickers etc., an edge of the label layer 17 abuts against the positioning ring 16, and the label layer 17 and the positioning ring 16 jointly wraps the sucking rod sleeve 1 therein.

The atomizer 2 comprises a heating wire 211 and a fiber member 212 for supporting the heating wire 211 and absorbing the liquid smoke, the fiber member 212 is capable of absorbing liquid and reserving liquid like a sponge, and is capable of being made of fiberglass or a material having liquid-absorbent and liquid barrier properties such as cotton material.

In this embodiment, to have a simple and compact internal structure of the sucking rod 90, the nozzle 4 is also served as a part of the liquid smoke cup 3, the liquid smoke cup 3 comprises a cup holder 31 and the nozzle 4 which are opposite to and separate from each other in a certain distance and tightly engaged with the inner wall of the sucking rod sleeve 1 by expansion, and a liquid storage component 32 fixed between the cup holder 21 and the nozzle 4.

Figure 4:
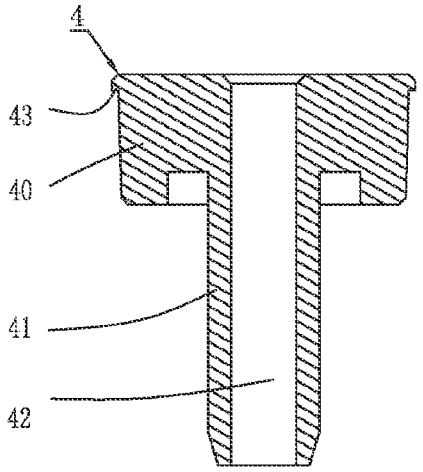
FIG. 4 is a cross-sectional view of a nozzle of the soft sucking rod for electronic cigarette in accordance with the first embodiment of the present invention.

As shown in FIG. 4, the nozzle 4 comprises a cylindrical cover body 40 and a first positioning post 41 coaxially extended from an end of the cover body 40, the nozzle 4 further defines a nozzle vent 42 coaxially extended through the cover body 40 and the first positioning post 41. The cover body 40 is further configured with a positioning flange 43 at its outer wall for engaging with an end portion of the sucking rod sleeve 1. The cover body 40 is tightly engaged with the inner wall of the sucking rod sleeve 1 by expanding its outer wall and positioned by means of the positioning flange 43, and a junction of the cover body 40 and the sucking rod sleeve 1 is put with glue to seal. The nozzle 4 is capable of being made of soft materials, such as: Silicone, rubber, PVC, TPU or PE etc., so as to get good mouth feel and lower manufacturing cost.

The liquid storage component 32 is a cylinder, for absorbing and reserving the liquid smoke injected into the liquid smoke cup 3 for subsequent atomization by the atomizer 2, which is capable of absorbing liquid and reserving liquid like a sponge, and being made of a material having liquid-absorbent and liquid barrier properties such as non-woven cloth, wood pulp cotton, chemical fiber cotton or PVA etc. The liquid storage component 32 defines a through hole 321 at its central portion, for ventilation and installation of the atomization 2. The liquid storage component 32 further defines a stepped shaft-shaped groove 322 (see FIG. 2 and FIG. 3) at its end engaged with the cup holder 31 for insertion of the cup holder 31.

Figure 5:
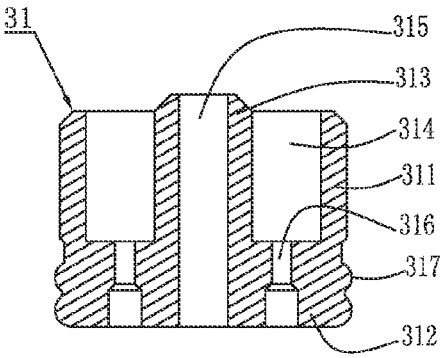
FIG. 5 is a cross-sectional view of a cup holder of the soft sucking rod for electronic cigarette in accordance with the first embodiment of the present invention.

As shown in FIG. 5, the cup holder 31 has a cylindrical cup-shaped structure, and comprises a side wall 311 and a bottom wall 312, the bottom wall 312 of the cup holder 31 is axially extended to form a second positioning post 313, and an annular inner chamber 314 is defined between the second positioning post 313 and an inner wall of the cup holder 31 for accommodating the liquid storage component 32, the cup holder 31 defines a cup holder vent 315 coaxially extended through the second positioning post 313 and the bottom wall 312, and the bottom wall 312 is further configured with perforations 316 axially extended therethrough. The cup holder 31 is further configured with an annular hermetical ring 317 on its outer wall for sealing and tightly engaging by expansion with the inner wall of the sucking rod sleeve 1.

Figure 2:
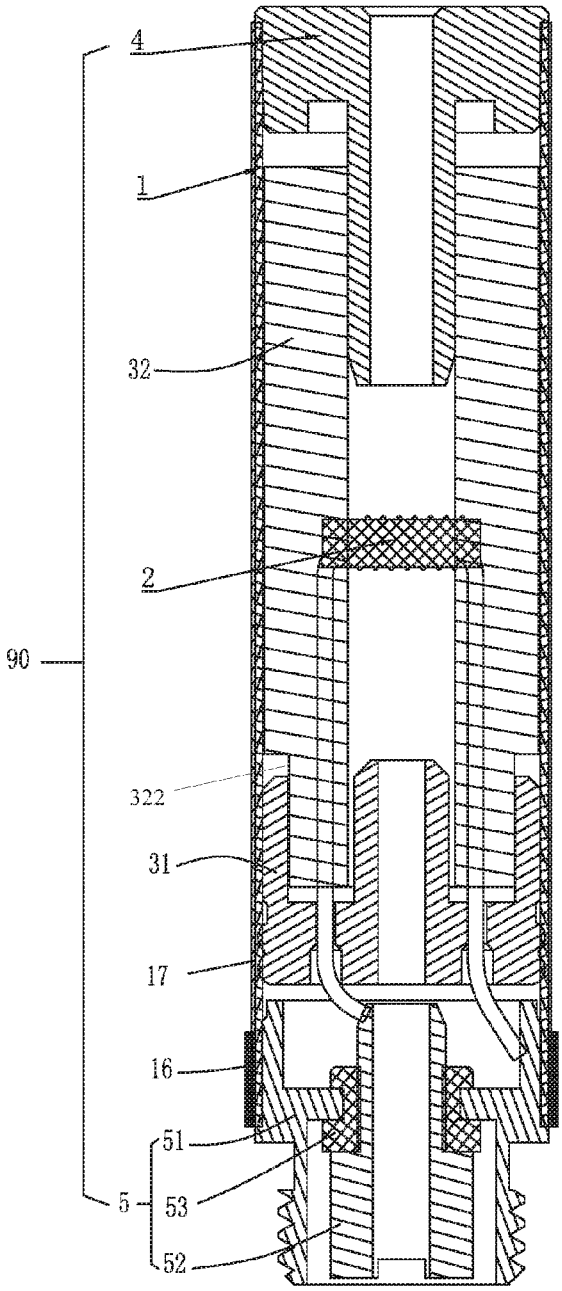
FIG. 2 is a cross-sectional view of the soft sucking rod for electronic cigarette in accordance with the first embodiment of the present invention.
Figure 3:
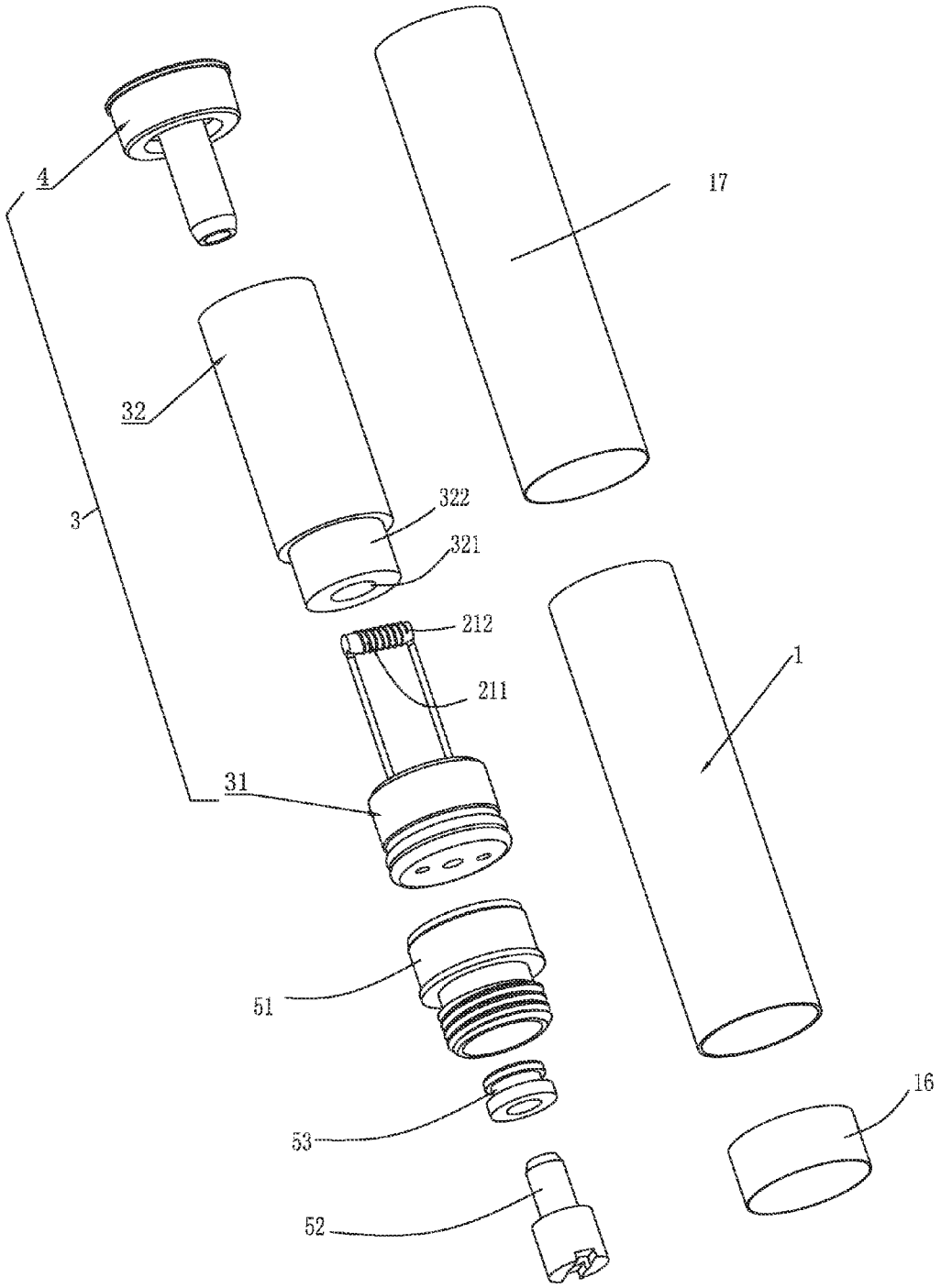
FIG. 3 is an exploded view of the soft sucking rod for electronic cigarette in accordance with the first embodiment of the present invention.

As shown in FIG. 2, the first positioning post 41 of the nozzle 4 and the second positioning post 313 of the cup holder 31 is corresponded to each other, and both of them are inserted into the through hole 321 of the liquid storage component 32 and respectively fix opposite ends of the liquid storage component 32, so that the liquid storage component 32 is supported in the liquid smoke cup 3 without deformation and having the required strength, to prevent or decrease the liquid smoke in the liquid storage component 32 from being squeezed out because the sucking rod 90 with soft shell is squeezed during smoking.

As shown in FIG. 2, the fiber member 212 is fixed within the through hole 321 in a radial direction of the liquid storage component 32 and its opposite ends abut against the liquid storage component 32 to absorb the liquid smoke for the heating wire 211 to atomize it; the heating wire 211 is wound around the fiber member 212, opposite ends of the heating wire 211 are respectively attached on a side wall of the through hole 321 and pass out of the perforations 316 in the bottom wall of the cup holder 31 of the liquid smoke cup 3 and are electrically connected with the positive electrode and the negative electrode of the power rod connector 5, and junctions between the heating wire 211 and the perforations 316 are circumferentially sealed.

Figure 6:
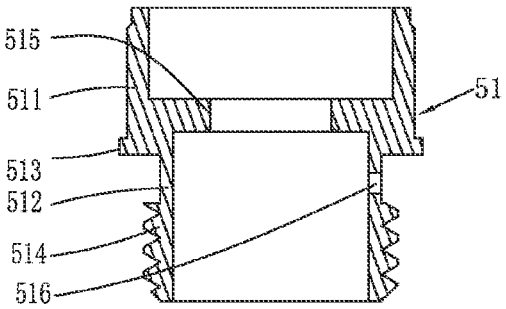
FIG. 6 is a cross-sectional view of a connecting member of the soft sucking rod for electronic cigarette in accordance with the first embodiment of the present invention.

The power rod connector 5 comprises a connecting member 51 serving as a first electrode (such as negative electrode) of the atomizer 2, a sucking rod electrode 52 serving as a second electrode (such as positive electrode) of the atomizer 2 and an insulating member 53 for insulating the connecting member 51 and the sucking rod electrode 52. As shown in FIG. 6, the connecting member 51 is substantially hollow cylinder-shaped, and comprises a cylindrical main portion 511 having an increased diameter and a cylindrical connecting portion 512 having a reduced diameter, and a positioning flange 513 is configured between the main portion 511 and the connecting portion 512 and radially outwardly extended from the main portion 51 for engaging with a connecting end of the sucking rod sleeve 1, the main portion 511 is inserted into and positioned in the sucking rod sleeve 1, the connecting portion 512 is configured with an outer thread joint 514 for connecting with a power rod 95 and an intake hole 516 for air to come in. The connecting member 51 further defines a locking slot 515 in its inner wall for mounting the sucking rod electrode 52, and the sucking rod electrode 52 is inserted into the locking slot 515 of the connecting member 51 by means of the insulating member 53. The sucking rod electrode 52 further defines a vent (not labeled) coaxially extended therethrough.

Figure 7:
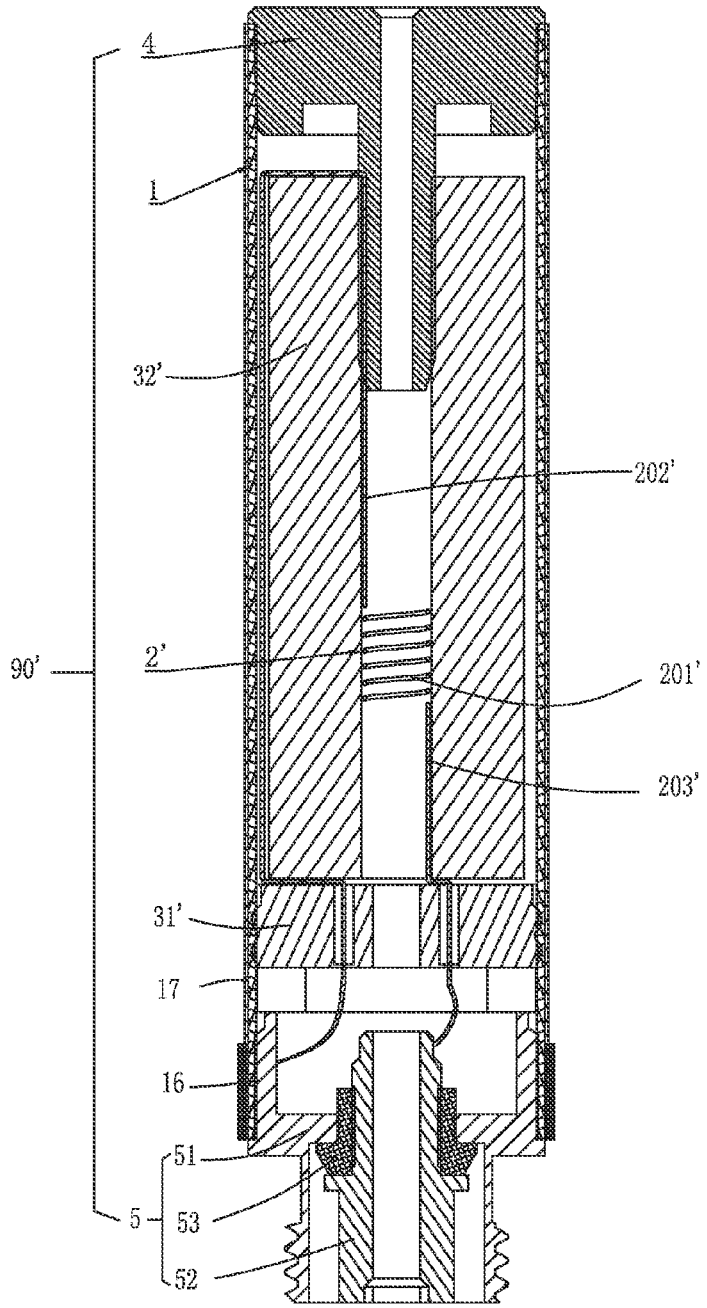
FIG. 7 is a cross-sectional view of a soft sucking rod for electronic cigarette in accordance with a second embodiment of the present invention.

As shown in FIG. 7, another embodiment of the present invention provides another soft sucking rod 90' for electronic cigarette, which has similar structure with the soft sucking rod 90, but has different cup holder 31' and atomizer 2'. The cup holder 31' is cylinder-shaped, and defines a venthole (not labeled) coaxially extended therethrough, and two perforations (not labeled) axially extended therethrough at opposite sides of the venthole, and the cup holder 31' is further configured with an annular hermetical ring (not labeled) on its outer wall for sealing and tightly engaging by expansion with the inner wall of the sucking rod sleeve 1. The atomizer 2' is a heating wire, and comprises a spiral main part 201' and a first electronic wire 202' and a second electronic wire 203' disposed at opposite ends of the main part 201' and respectively serving as positive and negative electrodes, the main part 201' is affixed onto an inner wall of the through hole 321 of the liquid storage component 32 and is coaxial with the liquid storage component 32. The first electronic wire 202' and the second electronic wire 203' pass through the through hole 321 and further go out of the cup holder 31' to be electrically connected with the positive and negative electrodes of the power rod connector 5. Specifically, the first electronic wire 202' extends along the inner wall of the through hole 321 beyond a first end surface of the liquid storage component 32 adjacent to the nozzle and extends along the first end surface after a first bending, and then extends along the outer wall of the liquid storage component 32 to a second end surface of the liquid storage component 32 adjacent to the cup holder 31' after a second bending, then continues to extend along the second end surface of the liquid storage component 32 to a corresponding perforation of the cup holder 31' after a third bending, and passes through the perforation after a fourth bending to be electrically connected with the first electrode of the power rod connector 5; the second electronic wire 203' extends along the inner wall of the through holes 321 beyond the second end surface of the liquid storage component 32 adjacent the cup holder 31' and extends to a corresponding perforation along the second end surface after a first bending, and passes through the perforation after a second bending to be electrically connected with the second electrode of the power rod connector 5. The first electronic wire 202' after repeated bending ensures the liquid storage component 32 to be supported within the liquid smoke cup 3 without deformation and having the required strength, and prevents or decreases the liquid smoke in the liquid storage component 32 from being squeezed out because the sucking rod 90' with soft shell is squeezed during smoking.

Figure 8:
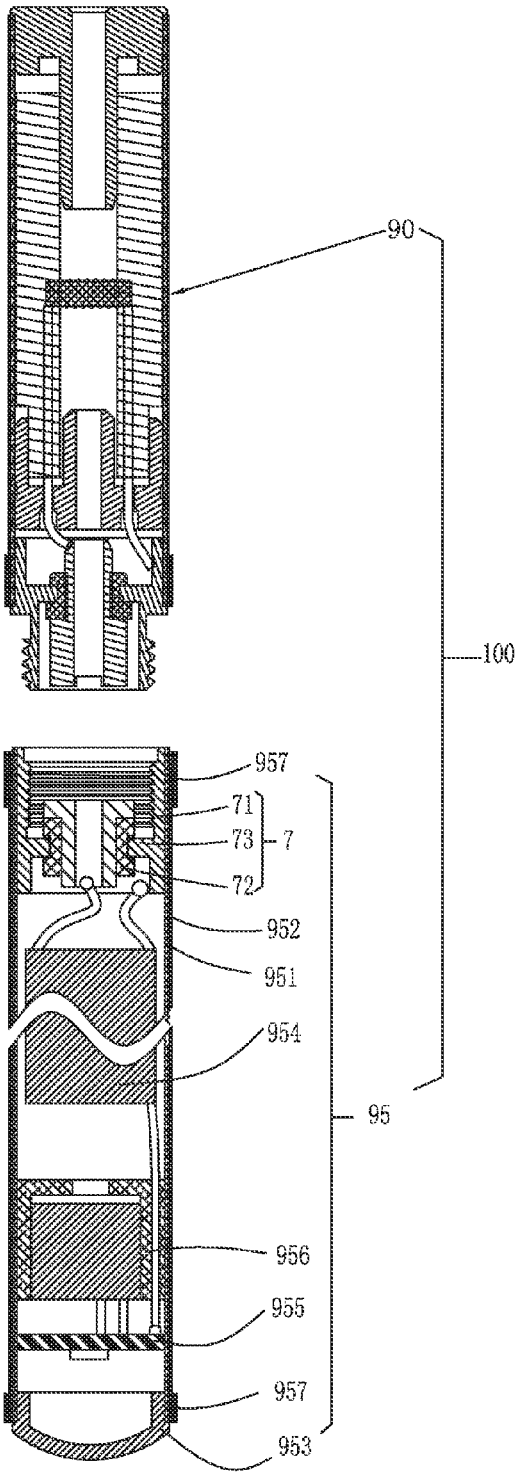
FIG. 8 is an exploded view of an electronic cigarette of a first embodiment in the present invention.

As shown in FIG. 8, an embodiment of the present invention further provides an electronic cigarette 100, the electronic cigarette 100 comprises the soft sucking rod 90 (or the soft sucking rod 90') and a power rod 95, the sucking rod 90 (or the soft sucking rod 90') is connected with the power rod 95 by means of clamp, plug or screw, in this embodiment by screw.

The power rod 95 comprises a power rod sleeve 951. The power rod sleeve 951 is also made of soft materials as same as the sucking rod cylinder 1. Since it is made of soft materials, the power rod sleeve 951 has good touch feel when hold in hand, and can save production cost, and furthermore an outer wall of the power rod sleeve 951 made of soft materials is easy to be affixed with a label layer of trademarks or advertising.

The power rod sleeve 951 is substantially cylinder-shaped, and has its one end which is connected with the sucking rod 90 to be configured with a sucking rod connector 7 for engaging with the power rod connector 5, and has its another end to be configured with a bottom cap 953. The power rod sleeve 951 is configured with a storage power 954, a control assembly 955 and a control assembly holder 956 therein. The sucking rod connector 7 is constituted by a connecting sleeve 71, a power electrode 72 and an insulating ring 73, the connecting sleeve 71 is cylindrical, and tightly engaged with an inner wall of the power rod sleeve 951 by expanding its outer wall, the connecting sleeve 71 is configured with inner threads on its inner wall and a locking slot for mounting the power electrode 72, the power electrode 72 is coaxially sleeved within the connecting sleeve 71 by means of the insulating ring 73, and the power electrode 72 and the connecting sleeve 71 are respectively connected with the positive and negative electrodes. The sucking rod connecter 7 has its one end to be inserted into the power rod sleeve 951 and tightly engaged by expansion with the inner wall of the power rod sleeve 951, and the power rod sleeve 951 is also configured with an annular positioning ring 957 at its outer wall where the sucking rod connector 7 and the power rod sleeve 951 are connected for firmly clamping the power rod sleeve 951 and the sucking rod connector 7. The power rod sleeve 951 at its outer wall is also configured with a label layer 952 for advertising or trademarks, similarly, an edge of the label layer 952 abuts against the positioning ring 957, and they jointly wraps the power rod sleeve 951 therein. The bottom cap 953 defines an intake (not shown) for external air to get into the power rod 95. The control assembly 955 is used for controlling the entire electronic cigarette to work, and connected with the atomizer 2 by means of the sucking rod connector 7 and the power rod connector 5, and configured with a miniature pneumatic switch to control the conduction of circuit to start the electronic cigarette to work, the heating wire 211 is controlled by the control assembly 955 to work; the control assembly holder 956 is positioned on the inner wall of the power rod sleeve 951, while the control assembly 955 is positioned in the control assembly holder 956 and electrically connected with the storage power 954. The control assembly holder 956 defines a receiving slot for accommodating the control assembly 955 and a vent (not labeled) axially extended therethrough.

In addition, as shown in FIG. 8, the external air enters the power rod 95 from the vent of the bottom cap 953 at the bottom of the power rod 95, and then passes by the vents of the power electrode 72 and the sucking rod electrode 52, the vent of the cup holder 31 of the liquid smoke cup 3 and the through hole 321 of the liquid storage component 32, and finally flows out of the sucking rod 90 from the vent 42 of the nozzle 4, so that an unique air channel is defined within the electronic cigarette, to get smooth airflow between the electronic cigarette and the exterior. Certainly, the external air can also directly pass by a gap between the sucking rod 90 and the power rod 95 and then enter the sucking rod electrode 52 through the vent 516 of the connecting member 51. Before the electronic cigarette works, a little amount of liquid smoke is infiltrated from the liquid storage component 32 and stored in the fiber member 212, during work, the heating wire 211 of the atomizer 2 is conducted and generates heat, to heat and atomize the liquid smoke stored in the fiber member 212 to be smog, the smog passes by the through hole 321 of the liquid storage component 32 and the vent 42 of the nozzle 4 and is inhaled by the user.

Figure 9:
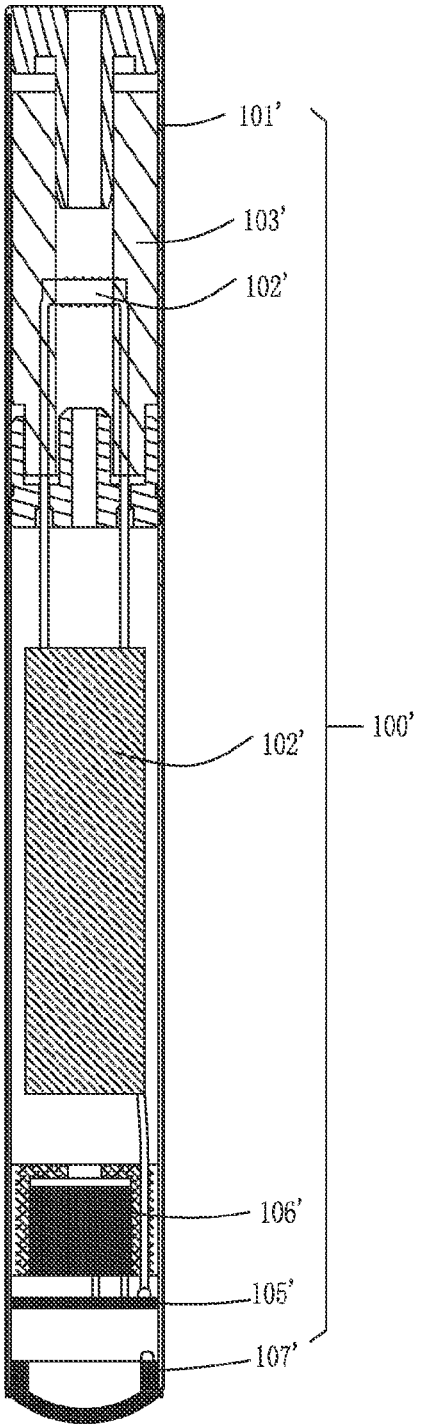
FIG. 9 is a cross-sectional view of an electronic cigarette of a second embodiment in the present invention.

As shown in FIG. 9, an embodiment of the present invention further provides another electronic cigarette 100', the electronic cigarette 100' has an integrated structure, and has a substantially same internal structure as the electronic cigarette 100 constituted by the sucking rod 90 and the power rod 95. The electronic cigarette 100' has its sucking rod and power rod un integrated, therefore the power rod connector and the sucking rod connecter are omitted, and comprises an integrated cylindrical shell 101' made of soft materials, the shell 101' is configured with an atomizer 102' as same as the atomizer 2 and a liquid smoke cup 103' as same as the liquid smoke cup 3, and a storage power 104', a control assembly 105', a control assembly holder 106' and a bottom cap 107' having vent, the atomizer 102' has its positive and negative electrodes to be electrically connected with the positive and negative electrodes of the storage power 104' via the control assembly 105', and controlled by the control assembly 105'.

The above-described is embodiments of the present invention, it should be noted that, for the persons of ordinary skill in this field, various changes and improvements within the principle and spirit of the present invention can be made, and the changed and improved solutions also fall into the protecting scope of the present invention.

What is claimed is:

1. A soft sucking rod for an electronic cigarette, comprising a sucking rod sleeve with hollow inner chamber, a liquid smoke cup configured within the sucking rod sleeve for reserving liquid smoke and an atomizer for transforming the liquid smoke into smog; wherein the sucking rod sleeve is made of soft materials, the liquid smoke cup is configured with a liquid storage component therein for reserving the liquid smoke, the liquid storage component defines a through hole in its central portion as a smog channel, the atomizer is configured in the smog channel of the liquid smoke cup, the atomizer atomizes the liquid smoke which is near the atomizer and stored in the liquid storage component;

the sucking rod sleeve has its opposite ends to be respectively configured with a nozzle and a power rod connector for connecting with an external power supply, the liquid smoke cup comprises the nozzle and a cup holder which are opposite to and separate from each other in a certain distance and tightly engaged with an inner wall of the sucking rod sleeve by expansion, and a liquid storage component fixed between the nozzle and the cup holder, and a liquid storage space of the liquid smoke cup is defined jointly by the nozzle, the cup holder and the sucking rod sleeve;

the liquid storage component is cylindrical and configured with the through hole coaxially extended therethrough;

the nozzle comprises a cylindrical cover body and a first positioning post coaxially extended from an end of the cover body, the nozzle defines a nozzle vent coaxially extended through the cover body and the first positioning post, the nozzle is made of soft materials;

the cup holder has a cylinder cup-shaped structure, and enclosed by a side wall and a bottom wall, the cup holder is configured with a second positioning post axially extended from its bottom wall, an annular inner chamber is defined between the second positioning post and an inner wall of the cup holder for accommodating the liquid storage component, the cup holder defines a cup holder vent coaxially extended through the second positioning post and the bottom wall, the first positioning post of the nozzle and the second positioning post of the cup holder is corresponded to each other, and both of them are inserted into the through hole of the liquid storage component and respectively fix opposite ends of the liquid storage component and support the liquid storage component;

the atomizer comprises a heating wire and a fiber member for supporting the heating wire and absorbing the liquid smoke, the fiber member is fixed within the through hole in a radial direction of the liquid storage component and its opposite ends abut against the liquid storage component to absorb the liquid smoke for the heating wire to atomize it the heating wire is wound around the fiber member, opposite ends of the heating wire are respectively attached on a side wall of the through hole and pass out of the cup holder and are electrically connected with the positive electrode and the negative electrode of the power rod connector; the cup holder of the liquid smoke cup further defines perforations axially extended through the bottom wall of the cup holder for extension of the heating wire, and junctions between the heating wire and the perforations are circumferentially sealed.

2. The sucking rod as described in claim 1, wherein, the liquid storage component further defines a stepped groove at its end engaged with the cup holder for insertion of the cup holder.

3. The sucking rod as described in claim 1, wherein, the cup holder is cylinder-shaped, and defines a venthole coaxially extended therethrough, and two perforations axially extended therethrough at opposite sides of the venthole, and the cup holder is further configured with an annular hermetical ring on its side wall for sealing and tightly engaging by expansion with the sucking rod sleeve.

4. The sucking rod as described in claim 1, wherein, the liquid storage component is non-woven cloth, wood pulp cotton, chemical fiber cotton or PVA, which have liquid-absorbent and liquid barrier properties.

5. A soft sucking rod for an electronic cigarette, comprising a sucking rod sleeve with hollow inner chamber, a liquid smoke cup configured within the sucking rod sleeve for reserving liquid smoke and an atomizer for transforming the liquid smoke into smog; wherein the sucking rod sleeve is made of soft materials, the liquid smoke cup is configured with a liquid storage component therein for reserving the liquid smoke, the liquid storage component defines a through hole in its central portion as a smog channel, the atomizer is configured in the smog channel of the liquid smoke cup, the atomizer atomizes the liquid smoke which is near the atomizer and stored in the liquid storage component;

the sucking rod sleeve has its opposite ends to be respectively configured with a nozzle and a power rod connector for connecting with an external power supply, the liquid smoke cup comprises the nozzle and a cup holder which are opposite to and separate from each other in a certain distance and tightly engaged with an inner wall of the sucking rod sleeve by expansion, and a liquid storage component fixed between the nozzle and the cup holder, and a liquid storage space of the liquid smoke cup is defined jointly by the nozzle, the cup holder and the sucking rod sleeve;

the liquid storage component is cylindrical and configured with the through hole coaxially extended therethrough;

the nozzle comprises a cylindrical cover body and a first positioning post coaxially extended from an end of the cover body, the nozzle defines a nozzle vent coaxially extended through the cover body and the first positioning post, the nozzle is made of soft materials;

the cup holder is cylinder-shaped, and defines a venthole coaxially extended therethrough, and two perforations axially extended therethrough at opposite sides of the venthole, and the cup holder is further configured with an annular hermetical ring on its side wall for sealing and tightly engaging by expansion with the sucking rod sleeve;

wherein, the atomizer is a heating wire, and comprises a spiral main part and a first electronic wire and a second electronic wire disposed at opposite ends of the main part and respectively serving as positive and negative electrodes, the main part is affixed onto an inner wall of the through hole of the liquid storage component and is coaxial with the liquid storage component, and the first electronic wire and the second electronic wire pass through the through hole and further go out of the cup holder to be electrically connected with the positive and negative electrodes of the power rod connector.

6. The sucking rod as described in claim 5, wherein, the first electronic wire extends along the inner wall of the through hole beyond a first end surface of the liquid storage component adjacent to the nozzle and extends along the first end surface after a first bending, and then extends along the outer wall of the liquid storage component to a second end surface of the liquid storage component adjacent to the cup holder after a second bending, then continues to extend along the second end surface of the liquid storage component to a corresponding perforation of the cup holder after a third bending, and passes through the perforation after a fourth bending to be electrically connected with the first electrode of the power rod connector; the second electronic wire extends along the inner wall of the through holes beyond the second end surface of the liquid storage component adjacent the cup holder and extends to a corresponding perforation along the second end surface after a first bending, and passes through the perforation after a second bending to be electrically connected with the second electrode of the power rod connector.

7. The sucking rod as described in claim 6, wherein, the power rod connector comprises a connecting member serving as a first electrode of the atomizer, a sucking rod electrode serving as a second electrode of the atomizer and an insulating member for insulating the connecting member and the sucking rod electrode; the sucking rod electrode is inserted into a central portion of the connecting member by means of the insulating member.

8. The sucking rod as described in claim 7, wherein, the connecting member is substantially hollow cylinder-shaped, and comprises a cylindrical main portion having an increased diameter and a cylindrical connecting portion having a reduced diameter, and a positioning flange is configured between the main portion and the connecting portion and radially outwardly extended from the main portion for engaging with a connecting end of the sucking rod sleeve, the main portion is inserted into and positioned in the sucking rod sleeve, the connecting portion is configured with an outer thread joint for connecting with a power rod and an intake hole for air to come in; the connecting member further defines a locking slot in its inner wall for mounting the sucking rod electrode, and the sucking rod electrode is inserted into the locking slot of the connecting member by means of the insulating member; the sucking rod electrode further defines a vent coaxially extended therethrough.

* * * * *